US006435336B1

(12) United States Patent
Knödler

(10) Patent No.: US 6,435,336 B1
(45) Date of Patent: Aug. 20, 2002

(54) PARTS TRANSFER SYSTEM

(75) Inventor: Richard Knödler, Schwäbisch Gmünd (DE)

(73) Assignee: Schuler Pressen GmbH & Co. KG, Goppingen (DE)

( * ) Notice: Subject to any disclaimer, the term of this patent is extended or adjusted under 35 U.S.C. 154(b) by 0 days.

(21) Appl. No.: 09/561,900

(22) Filed: May 1, 2000

(30) Foreign Application Priority Data

Apr. 29, 1999 (DE) ..... 199 19 434

(51) Int. Cl.[7] ..... B65G 29/00; B65G 47/84; B65G 37/00; B65G 47/34; B65G 25/00

(52) U.S. Cl. ..... 198/474.1; 198/468.2; 198/468.9; 198/470.1

(58) Field of Search ..... 198/468.2, 468.3, 198/468.6, 468.9, 470.1, 474.1

(56) References Cited

U.S. PATENT DOCUMENTS 4,742,205 A * 5/1988 Vuichard ..... 219/69 M
4,823,934 A * 4/1989 Lamaire et al. ..... 198/470.1 X
5,033,785 A * 7/1991 Woolley, Jr. ..... 901/32 X
5,190,138 A * 3/1993 Strasser et al. ..... 198/470.1 X
5,873,488 A * 2/1999 Guerra ..... 221/220 X
6,079,541 A * 6/2000 Bercelli et al. ..... 198/470.1 X

FOREIGN PATENT DOCUMENTS

| | | |
|---|---|---|
| DE | 2741581 | 3/1979 |
| DE | 19725765 | 12/1998 |
| EP | 0402229 | 12/1990 |

* cited by examiner

*Primary Examiner*—Christopher P. Ellis
*Assistant Examiner*—Gene O. Crawford
(74) *Attorney, Agent, or Firm*—Crowell & Moring LLP

(57) ABSTRACT

A transport system, particularly for forming machines for cold forming or warm forming, has a holding rail with gripper devices which are each separately controlled by way of servomotors. The transmissions provided for the force transmission between the servomotor and the clamping jaws of the gripper device can be self-locking, but transmit independently thereof the rotating movement of the respective servomotor continuously to the clamping jaws which therefore swivel. For a better control or automatic control of the gripper devices, these transmissions can be provided with sensors for detecting the force and/or the position.

19 Claims, 6 Drawing Sheets

PARTS TRANSFER SYSTEM

BACKGROUND AND SUMMARY OF THE INVENTION

This application claims priority of German application 199 19 434.3, filed on Apr. 29, 1999, the disclosure of which is expressly incorporated by reference herein.

The present invention relates to a transport system, particularly for the transfer of workpieces, particularly in a forming machine for massive forming.

During massive forming and also during other forming operations, workpieces frequency pass successively through several stations. The stations may, for example, be forming stations in a pressing tool, in which case the workpiece must then be transported from one station to the next. As a rule, grippers are used for this purpose to grip the parts, which may be heavy, take these parts out of a station and feed them to the next station where they release them.

A transport system of this type is described in U.S. Pat. No. 3,456,814 which has several gripper devices fastened to a holding rail. Each gripper device is constructed in the manner of tongs and has two clamping jaws which are disposed to be swivellable toward and away from one another. They form two-armed levers, one of whose lever arms is used for clamping the workpiece and the other of whose lever arms is used for the operation. For this purpose, the lever arms are connected by way of push lugs with a toothed rack whose back-and-forth movement is converted into a swivelling movement of the clamping jaws. The push lugs are arranged such that, when the clamping jaws close, they stand approximately at a right angle to the moving direction of the toothed rack. This results in a very large gearing down and vice-versa in a very high power increase toward the end of the closing movement of the clamping jaws. For operating the clamping jaws, gear wheels are used which mesh with the toothed rack and which are driven by the main press drive. The holding forces occurring at the individual workpieces are a function of the tool measurements which are subject to a certain tolerance.

Another transport system for workpieces in forming machines is described in DE 2434540 C2. Also in this system, several mechanical gripping devices are provided which are formed of two clamping jaws respectively and which are operated by a central driving source. The grippers are formed by two clamping jaws respectively formed as two-armed levers, one lever arm of which respectively being used for gripping the workpiece, and the respective other lever arm being connected with a gear wheel in an articulated manner. The gear wheels or toothed segments mesh with one another and are driven by a central drive which causes the opening and closing of all grippers. Also in this system, the control of the gripping and holding forces on the individual clamping jaws is not possible in a targeted manner.

SUMMARY OF THE INVENTION

An object of the present invention is to provide an improved transport system.

This object has been achieved by a transport system having at least one gripper device configured to grip a workpiece and having at least one movably disposed clamping jaw, and at least one driving device individually assigned to the at least one gripper device, and arranged to individually cause gripping and releasing of the workpiece of the associated at least one gripper device.

Alternatively, at least one gripper device is configured to grip a workpiece and has at least one movably disposed clamping jaw, and at least one driving device has a servomotor and a transmission configured to transmit movement applied by the servomotor to the at least one gripper device. The servomotor is configured to definably control a clamping force exercised by at least one clamping jaw onto the workpiece.

The former type of transport system has at least one, preferably several, gripper devices to which one driving device respectively is individually assigned. This means that each gripper has a separate drive. In principle, the gripping movement is therefore steerable, adjustable and controllable independently of the gripping movement of the other grippers. This permits not only a non-synchronous working of the individual grippers as required but also the controlling and steering of the gripping forces, optionally independently of component tolerances.

In the latter transport system, a servomotor is provided as a driving device. This servomotor acts upon the gripping device by way of a gearing which permits a defined power transmission. This means that, within the moving range of a clamping jaw, the ratio between the moving path of the servomotor and of the clamping jaw has a defined finite value. As a result, by way of a suitable control of the servomotor, a defined clamping force or holding force can be adjusted at the workpiece.

The servo motor is preferably connected with a position generator which is connected to a control device for controlling the gripper device. As an alternative, or in addition, the servomotor may be connected with a device for detecting the forces applied by the servomotor. This device will then also be connected with the control device. The device for monitoring the clamping force may, for example, be a force sensor on the basis of a wire strain gauge, a current sensor in a line feeding power to the servomotor, or another suitable sensor.

The transport system according to the invention permits a precision control of the movement of the clamping jaws and a precision control of the force exercised by the clamping jaws onto the workpiece. This is particularly so if the gearing has a defined power transmission characteristic without singularities as they occur, for example, in the case of toggle mechanisms. This achieves not only the adaptation of the gripping movement to possible irregularities on the workpiece which are within the production tolerance but also the control of the holding force. Thereby damage to the workpiece is avoided and a secure holding of the workpiece is nevertheless permitted.

Further, in addition to their clamping position and their opening position, the clamping jaws can take over a third position and function which is, for example, the function of guiding the workpiece without clamping it. When a gripper device holds a workpiece, for example, above a bottom die, it is possible to reduce the clamping force such that, guided by the clamping jaws, the workpiece slides through between the clamping jaws and enters the bottom die. As a result of this measure, the transport curve of the gripping device is advantageously simplified. For example, when workpieces are placed in the bottom die, it may not be necessary to move the gripper device toward the bottom die.

In a preferred embodiment, a servomotor is provided as the drive source whose rotating movement is converted by a spindle-type gearing into a linear movement. As required, however, other devices for converting rotating movements into linear movements can also be used. A roller thread spindle is preferably used which has low friction with high transmitted forces. The linear movement is preferably transmitted by way of a lever mechanism, which is, for example, only two tension lugs, to the clamping jaws. In this case, it is preferable for the tension lug with the cooperating lever arm of the clamping jaw, to enclose in approximately a right angle. In this range, the force transmission from the output of the spindle-type gearing to the clamping jaw is relatively independent of the angular position of the clamping jaw. The gear-down ratio is almost constant to promote the controllability of the gripper device.

The gripper device is preferably fastened on a holding rail together with other gripper devices. This holding rail is preferably constructed such that it bounds a closed interior space. The driving device and the gearing can be housed completely in the interior. Here, they are largely protected from damaging effects. This applies particularly with respect to a possible heat radiation emanating from the workpiece in the case of warm forming processes. As required, the interior space enclosed by the holding rail can be acted upon by compressed air, in order to prevent the penetration of disturbing substances and their advancing to the gearing, the threaded spindle and/or the servomotor.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
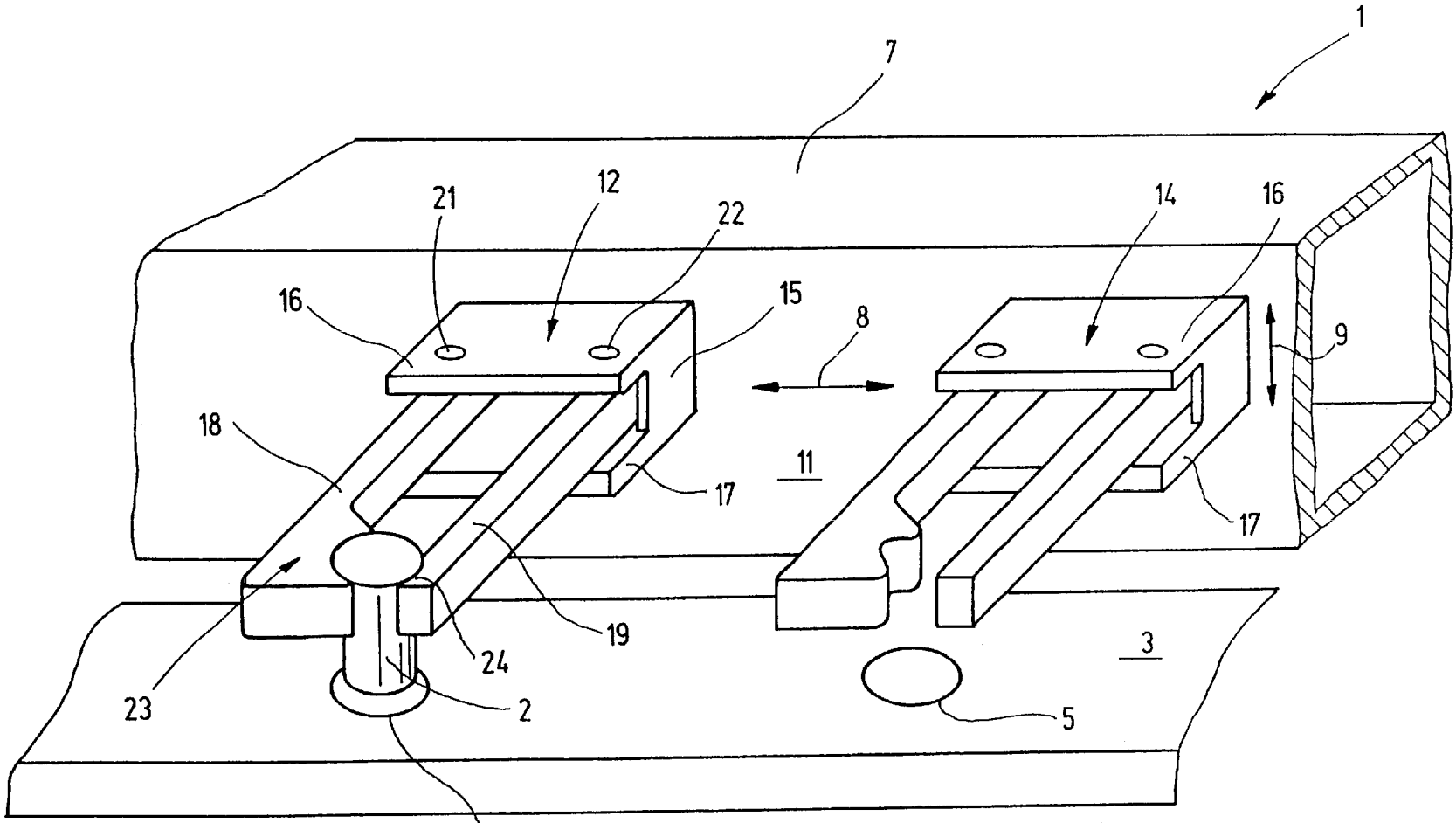
FIG. 1 is a schematic perspective view of a transport system.

FIG. 1 illustrates transport system 1 for transporting workpieces 2 through several dies 4, 5 provided in a tool 3. The transport system 1 comprises a holding rail 7 which can be longitudinally moved in a transport direction designated by an arrow 8 and, as required, is additionally disposed to be liftable and lowerable in a direction designated by an arrow 9.

On its side 11 facing the tool 3, the holding rail 7 has one or several gripper devices 12, 14 which are set up for gripping the workpiece and transporting it from station to station.

The gripper devices 12, 14 have identical constructions, so that the following description of the gripper device 12 also relates to the gripper device 14. The gripper device 12 has a support 15 provided on the front side 11 of the holding rail 7, which support contains an upper and a lower support plate 16, 17. The support 15 has a passage which leads into the interior space enclosed by the holding rail. Two clamping jaws 18, 19 are arranged between the two support plates 16, 17 and, in the clamping position, extend approximately parallel to one another away from the support 15. The clamping jaws 18, 19 project out of the support 15 and are disposed between the support plates 16, 17 to be swivellable about corresponding pins 21, 22 toward and away from one another. At their free end pointing away from the support 15, the clamping jaws 18 are provided with receiving devices for the workpiece 2. For example, on its side facing the workpiece 2, the clamping jaw 18 carries a prism 23, while the clamping jaw 19 has a plane contact surface 24.

Figure 2:
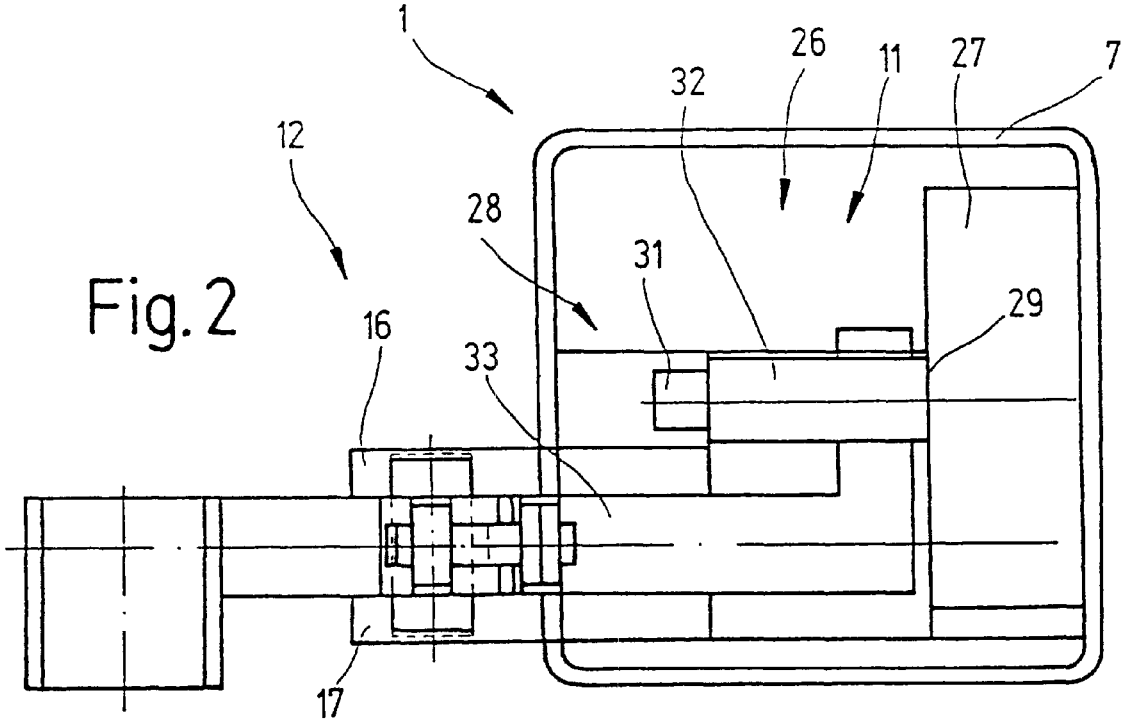
FIG. 2 is a cross-sectional view of the transport system according to FIG.1.
Figure 3:
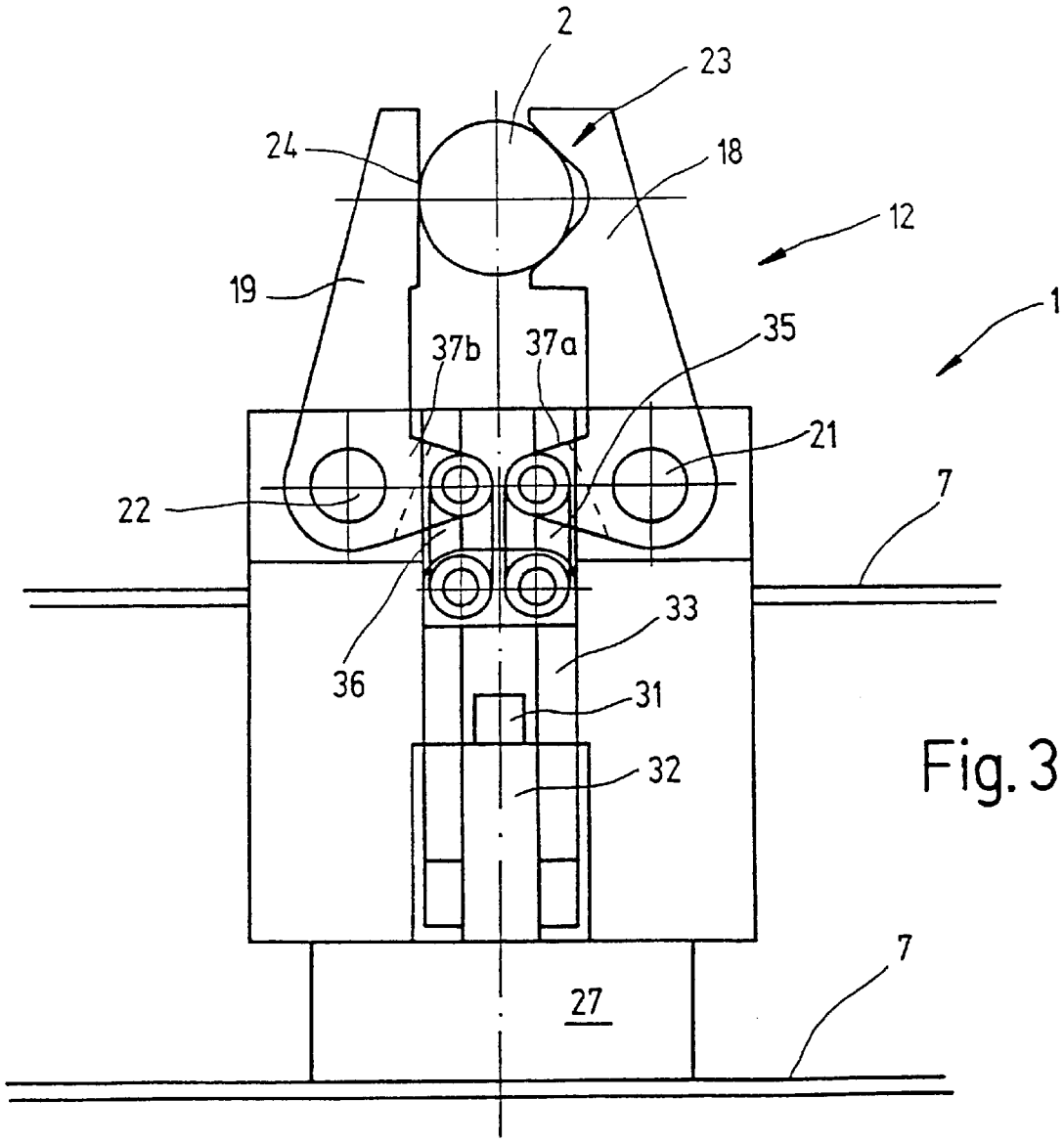
FIG. 3 is a top view of the transport system according to FIGS. 1 and 2 in the gripping position.

FIGS. 2 and 3 show a driving device 26 which is assigned to the gripper device 12 and which comprises a servomotor 27 and a gearing 28. The servomotor 27 is connected by its output shaft 29 with a threaded spindle 31, on which a threaded bush 32 is disposed. This threaded bush 32 is connected with a slide 33 which can be displaced away from the servomotor 27 and toward it in the direction of the axis of rotation of the threaded spindle 31 but offset parallel to the latter. In this case, the slide 33 is movable in a schematically illustrated guide.

On its side facing the gripper device 12, the slide 33 carries swivellable tension lugs 35, 36 which, by way of their end situated away from the slide 33, are swivellably connected with a lever arm 37*a*, 37*b* of the respective clamping jaw 18, 19. The lever arms 37*a*, 37*b* are oriented approximately at a right angle or also at an acute angle with respect to the other sections of the clamping jaws 18, 19 extending to the workpiece 2. In the closed position, when the prism 23 and the plane surface 24 rest against the workpiece 2, the lever arms 37*a*, 37*b* together with the tension lugs 35, 36 in each case enclose a right angle. However, minor deviations are definitely permissible.

Figure 4:
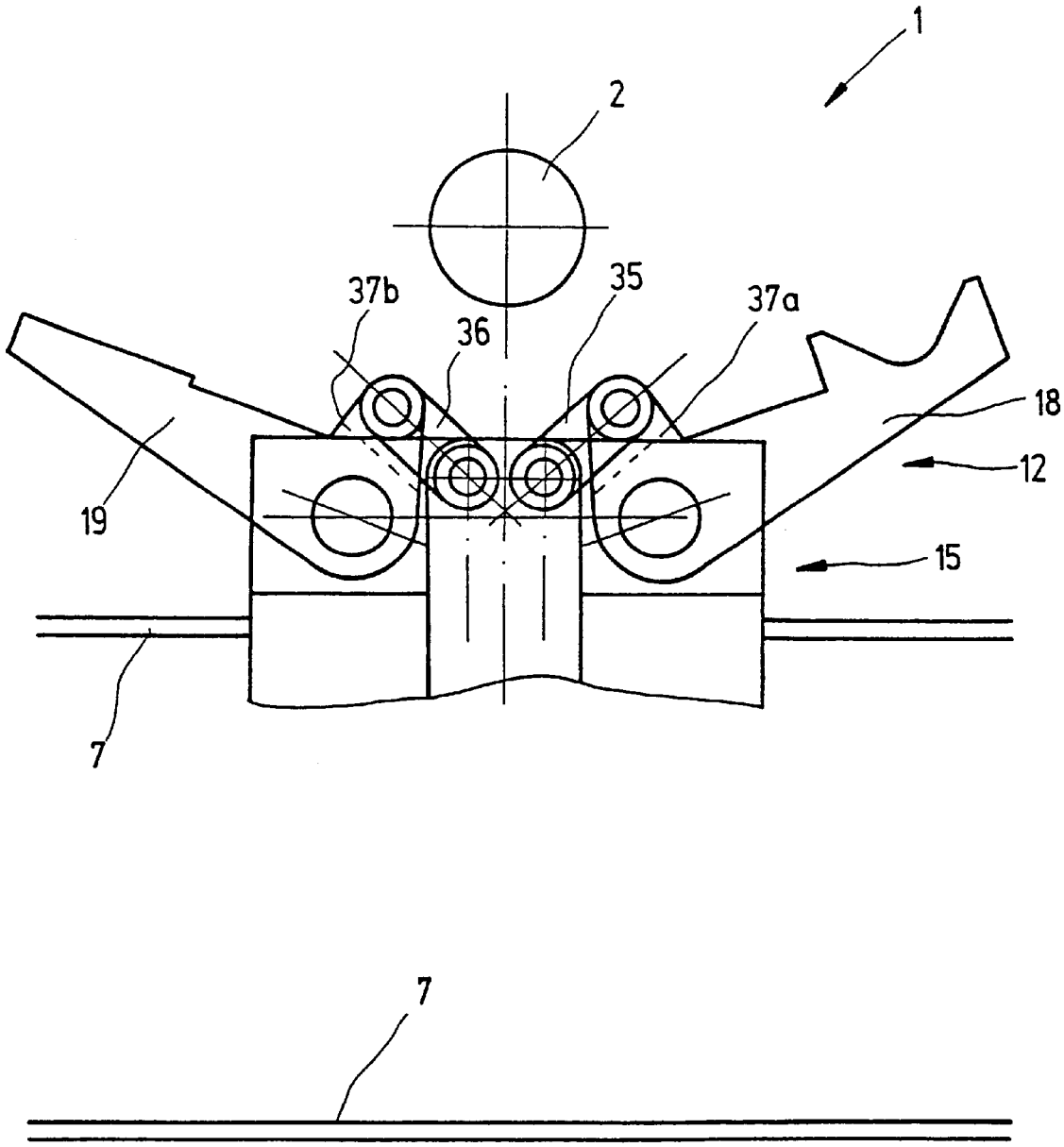
FIG. 4 is a top view of the transport system according to FIG. 3 in the release position.

The operation of the transport system 1 is now described on the assumption that the gripper device 12 is first in the position illustrated in FIG. 4. The slide 33 is in a position advanced the farthest in the support body 15. By way of the lever arms 37*a*, 37*b*, the tension lugs 35, 36 swivel the clamping jaws 18, 19 far away from the workpiece 2 in order to release this workpiece 2.

When the workpiece 2 is to be received by the gripper device 12, the servomotor 27 is controlled such that, as illustrated in FIG. 3, it pulls the threaded sleeve 32 and the slide 33 away from the gripper device 12. The tension lugs 35, 36 will now swivel the clamping jaws 18, 19 in that they pull on the lever arms 37*a*, 37*b*, in the clamping position. The clamping jaws 18, 19 are swivelled about the swivelling axes fixed with respect to the holding rail 7 and defined by the pins 21, 22.

When the clamping jaws 18, 19 come in contact with the workpiece 2 and the servomotor 27 is controlled further, the clamping jaws 18, 19 clamp in the workpiece 2. The torque of the servomotor 27 is transmitted to the workpiece 2 by way of the transmission 28, which is formed by the threaded spindle 31, the slide 33, the tension lugs 35, 36 and the lever arms 37*a*, 37*b*. By control of the motor torque of the servomotor 27, the clamping force on the workpiece 2 can be regulated relatively independently of its geometrical shape and dimensional accuracy. This can be carried out independently of the regulation of the gripping device 14. As an alternative, the servomotor 27 can be braked in the holding position or can stop by a detent moment without rotation.

When the workpiece 2 is clamped in between the clamping jaws 18, 19, it can be lifted out of the tool 3 in that the holding rail 7 is moved vertically, for example, in the direction of the arrow 9 in FIG. 1. As an alternative, the gripping device 12 can grip the workpiece at the illustrated height when it is guided out of the workpiece 3 by a lifting device without the assistance of the gripper device 12. As the result of the movement of the holding rail 7 in the direction of the arrow 8, the workpiece 2 can now be transported by the transport system 1 to the desired next position. During this operation, the clamping force on the workpiece 2 is maintained in that the servomotor 27, while the output shaft 29 is stopped, is continuously energized to such an extent that it applies a holding momentum which the transmission 28 converts into a holding force.

When the workpiece 2 has arrived at the next station, for example, at the die 5, the gripper device 12 will stop above this die. Now, the workpiece 2 can, for example, by way of a downward movement of the holding rail 9, be introduced into the corresponding die 5 (or die 4). As an alternative, a downward movement can be eliminated. The gripper device 12 is, for example, only relaxed (i.e., the clamping jaws 18, 19 are no longer pressed tightly against the workpiece 2) without being moved away from it. This can take place by the reduction of the energization of the servomotor 27, by the switching off of a minimum current or by a slight rotation in the opposite direction, so that the clamping jaws 18, 19 are moved slightly away from the workpiece 2. Under the effect of its own weight, the workpiece 2 can now slide into the die 5 (or 4). When the workpiece 2 is released, the clamping jaws 18, 19 can be swivelled away from one another in that the servomotor 27 is correspondingly controlled. Thus, there are three different conditions:

1. The clamping condition in which the servomotor 27 presses the clamping jaws 18, 19 by force toward one another and against the workpiece. The clamping force can be maintained, if the transmission 28 is self-locking, in that the servomotor 27 is switched off or in that the servo motor is controlled such that it applies a minimum momentum;
2. The workpiece guiding condition in which the clamping jaws 19, 19 hold the workpiece 2 between one another, but do not clamp it fast; and
3. The condition in which the clamping jaws 18, 19 completely release the workpiece 2 in that they swivel away from it.

For controlling the servomotor 27, sensors can be provided on the driving device 27 which characterize the applied, exercised or transmitted forces or the position of the servomotor 27 or parts of the transmission 28. For example, an angle generator can be provided at the servomotor 27. In addition, a path generator can be provided on the slide. The motor current can also be evaluated as a measurement for the generated torque. As an alternative, torque or force sensors can be provided.

The servomotor 27 and the transmission 26 can be housed completely in the interior of the holding rail 7. Likewise, optional sensors may be arranged there. Thus, the operation and the detection of the movement of the gripper device 12 or the remaining control of its operation takes place from the interior. As required, this interior can be acted upon by compressed air which exits the interior, for example, at the gripper devices 12, 14 and thus cools the servomotor 27 and the transmission 28. In addition, the air exiting there prevents dirt penetration.

Figure 5:
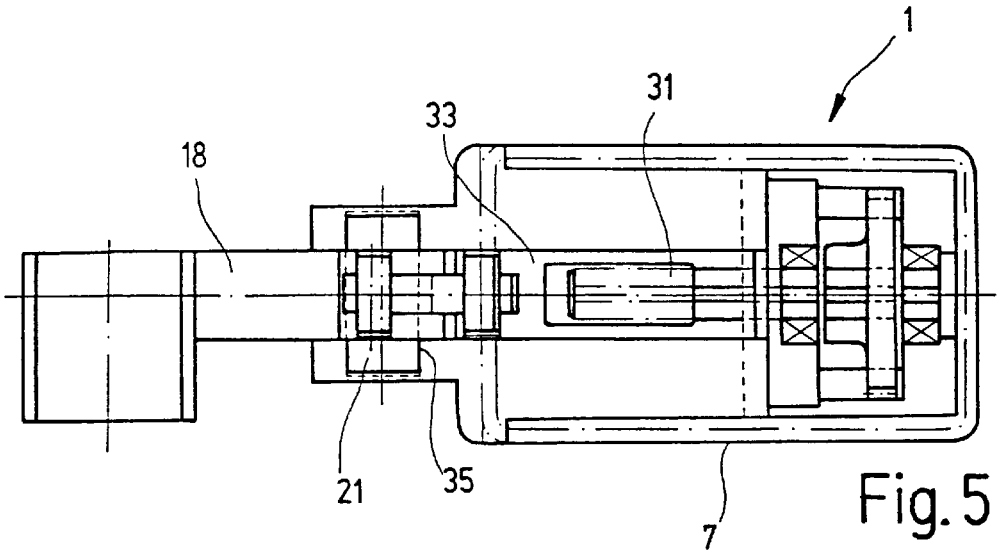
FIG. 5 is a sectional view of a modified embodiment of the transport system according to the invention.
Figure 6:
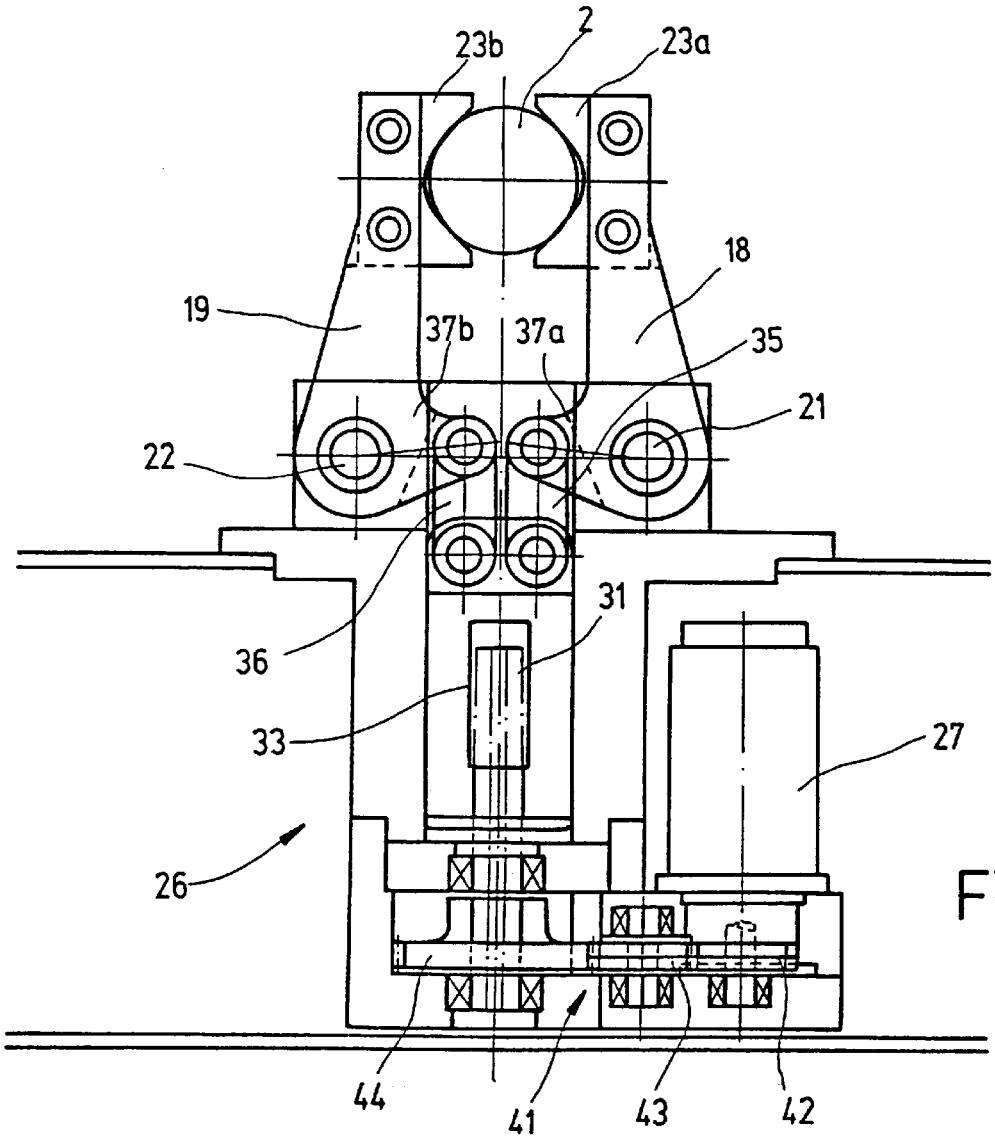
FIG. 6 is a schematic, partially sectional top view of the transport system according to FIG. 5 in the gripping position.
Figure 7:
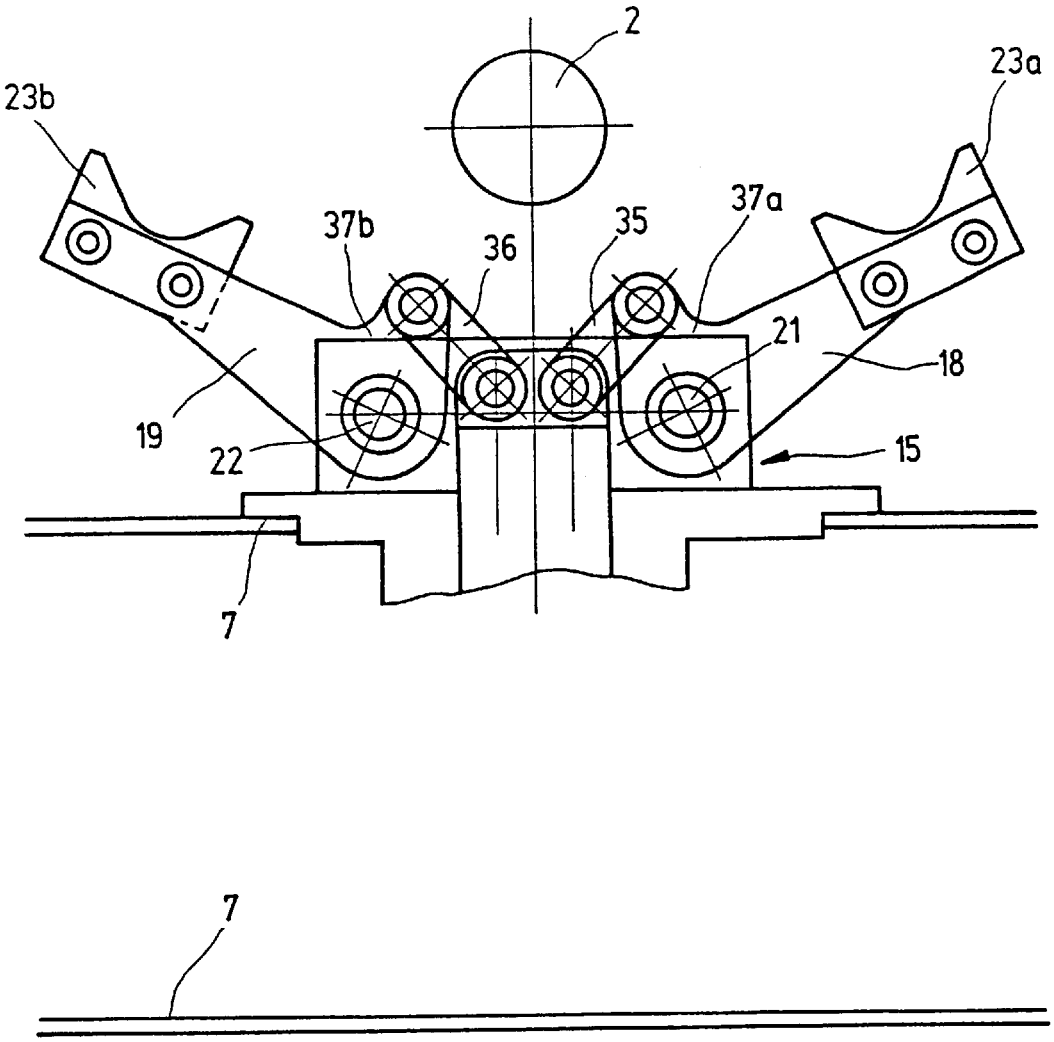
FIG. 7 is a top view of the transport system according to FIG. 6 in the release position.

FIGS. 5 to 7 illustrate a modified embodiment of the transport system 1. To the extent that there is a basic constructional and/or functional conformity with respect to the above-described embodiment of the transport system 1, the same reference numbers are used without another explanation as they have been already described.

While, in the case of the transport system 1 according to FIGS. 1 to 3, a servomotor 27 is used whose output shaft 29 is arranged approximately above the slide 33, the arrangement in the case of the transport system 1 according to FIGS. 5 to 7 is such that the servomotor 27 is arranged laterally of or beside the slide 33. The threaded spindle 31 is therefore situated beside the servomotor 27 approximately at the same level. In addition to the threaded spindle (roller-type threaded spindle) and the other elements described in connection with FIG. 3, the transmission 26 comprises a toothed gearing 41 which transmits the rotational movement of the servomotor 27 by way of three gear wheels 42, 43, 44 to the threaded spindle 31. The drive is quite flat, particularly if gear wheels 42, 43, 44 are used which have a relatively small diameter which can be achieved by using the idler gear 43, whereby, as illustrated in FIG. 5, a carrier rail 7 is used which is flat overall.

As required and as illustrated in FIGS. 6 and 7, respectively exchangeable prisms 23*a*, 23*b* may be provided on the clamping jaws 18, 19. These prisms 23*a*, 23*b* permit a simple adaptation to different workpieces 2. However, an adjustment of the gripper device 12 can usually be eliminated. The control device, which is not shown in detail, can control the servomotor 27 such that it stops when reaching a desired clamping force and maintains the clamping force. As an alternative or in addition, an automatic position control or a position control can be provided in the case of which different clamping and releasing positions are defined or set by programming. Likewise, the clamping forces can be adjusted by programming, to render mechanical adjustments unnecessary.

A transport system 1, particularly for forming machines for cold forming or warm forming, has a holding rail 1 with grippers devices 12, 14 which are each separately controlled by servomotors 27. The transmissions 26, which are provided for the force transmission between the servomotor 27 and the clamping jaws 18, 19 of the gripper device 12, 14, can be self-locking, but independently thereof, transmit the rotating movement of the respective servomotor 27 continuously to the clamping jaws 18, 19 which therefore swivel. For a better control or automatic control of the gripper devices 12, 14, sensors can be provided for detecting the force and/or the position.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A transport system for transferring workpieces in a forming machine, comprising:

at least one gripper device configured to grip a workpiece and having at least one movably disposed clamping jaw, and at least one driving device individually assigned to the at least one gripper device having a transmission for transmitting movement applied by a servo motor configured to definably control a clamping force exercised by the at least one clamping jaw and arranged to individually cause gripping and releasing of the workpiece of the associated gripper device wherein the at least one clamping jaw is disposed to be swivellable about a fixed rotation axis and is connectable via tension lugs with an output of spindle-type gearing formed by a roller-type threaded spindle.

2. The transport system according to claim 1, wherein the at least one gripper device is arranged to be carried by a holding device to transfer move the at least one gripper device in a targeted manner.

3. The transport system according to claim 2, wherein the holding device comprises a holding rail with an interior which is substantially closed off to the outside, and the driving device is completely integrated in the interior thereof.

4. The transport system according to claim 2, wherein the holding device comprises a holding rail with an interior which is substantially closed off to the outside, and the driving device is completely integrated in the interior thereof, and the position generator or the device for detecting the exercised force is arranged in the interior thereof.

5. The transport system according to claim 4, wherein the servo motor is operatively connected with a detecting device for detecting force applied by the servomotor, and the detecting device is operatively connected to the control device for controlling the force exercised by the at least one clamping jaw.

6. The transport system according to claim 2, wherein the interior is acted upon by compressed air.

7. The transport system according to claim 6, wherein the holding device comprises a holding rail with an interior which is substantially closed off to the outside, and the driving device is completely integrated in the interior thereof, and the position generator or the device for detecting the exercised force is arranged in the interior thereof.

8. A transport system for transferring workpieces in a forming machine, comprising:

at least one gripper device configured to grip a workpiece and having at least one movably disposed clamping jaw, and at least one driving device having a servomotor and a transmission containing a spindle-type gearing and configured to transmit movement applied by the servomotor to the at least one gripper device, the servomotor being configured to definably control a clamping force exercised by at least one clamping jaw onto the workpiece wherein the at least one clamping jaw is disposed to be swivellable about a fixed rotation axis and is connectable via tension lugs with an output of spindle-type gearing formed by a roller-type threaded spindle.

9. The transport system according to claim 8, wherein the servomotor is operatively connected with a detecting device for detecting force applied by the servomotor, and the detecting device is operatively connected to the control device for controlling the force exercised by the at least one clamping jaw.

10. The transport system according to claim 8, wherein the transmission comprises a lever mechanism.

11. The transport system according to claim 8, wherein the at least one gripper device comprises two movable clamping jaws arranged to be movable in a controlled manner toward and away from one another by the driving device.

12. The transport system according to claim 8, wherein the at least one gripper device is arranged to be carried by a holding device to transfer move the at least one gripper device in a targeted manner.

13. The transport system according to claim 8, wherein the at least one gripper device comprises two movable clamping jaws arranged to be movable in a controlled manner toward and away from one another by the driving device.

14. The transport system according to claim 8, wherein the transmission has a defined force-transmission characteristic.

15. The transport system according to claim 14, wherein the transmission has a substantially constant transmission ratio.

16. The transport system according to claim 8, wherein the servomotor is operatively connected with a position generator operably connected to a control device.

17. The transport system according to claim 16, wherein the at least one driving device has a servomotor and a transmission for transmitting the movement applied by the servomotor to the gripper device, and the servomotor is configured to definably control a clamping force exercised by at least one clamping jaw onto the workpiece.

18. The transport system according to claim 16, wherein the control device is configured so that the at least one clamping jaw is changeable into a first position into a clamped condition in which the workpiece is held fast, into at least one of a second position and a second condition in which the workpiece is displaceably guided by the clamping jaw, and into a third position in which the workpiece is released.

19. The transport system according to claim 18, wherein the servo motor is operatively connected with a detecting device for detecting force applied by the servomotor, and the detecting device is operatively connected to the control device for controlling the force exercised by the at least one clamping jaw.

* * * * *